US012089745B2

(12) United States Patent
Xie et al.

(10) Patent No.: US 12,089,745 B2
(45) Date of Patent: Sep. 17, 2024

(54) FOLDABLE CONNECTION MECHANISM AND ADJUSTABLE BED SYSTEM THEREWITH

(71) Applicant: Nisco Co., Ltd, Jiangsu (CN)

(72) Inventors: Jian Xie, Jiangsu (CN); Yifan Mao, Jiangsu (CN); Jinquan Ren, Jiangsu (CN); Hailong Sun, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 266 days.

(21) Appl. No.: 17/506,052

(22) Filed: Oct. 20, 2021

(65) Prior Publication Data

US 2022/0031083 A1 Feb. 3, 2022

Related U.S. Application Data

(60) Division of application No. 16/747,842, filed on Jan. 21, 2020, now Pat. No. 11,178,974, which is a continuation-in-part of application No. 16/729,700, filed on Dec. 30, 2019, now Pat. No. 11,317,729.

(60) Provisional application No. 62/796,172, filed on Jan. 24, 2019, provisional application No. 62/796,154, filed on Jan. 24, 2019, provisional application No. 62/790,583, filed on Jan. 10, 2019, provisional application No. 62/789,047, filed on Jan. 7, 2019, provisional application No. 62/789,062, filed on Jan. 7, 2019.

(51) Int. Cl.
*A47C 19/12* (2006.01)
*A47C 20/04* (2006.01)

(52) U.S. Cl.
CPC ..... *A47C 20/041* (2013.01); *A47C 19/122* (2013.01)

(58) Field of Classification Search
CPC ..... A47C 19/12; A47C 19/122; A47C 20/043; A47C 20/047; F16B 12/54; F16B 12/56; F16B 12/58; F16B 2200/67
See application file for complete search history.

(56) References Cited

U.S. PATENT DOCUMENTS 6,035,467 A * 3/2000 Lee ..... A47C 17/70 5/174
7,437,783 B2 * 10/2008 Navarro ..... A47C 19/005 5/304

(Continued)

*Primary Examiner* — Justin C Mikowski
*Assistant Examiner* — Ifeolu A Adeboyejo
(74) *Attorney, Agent, or Firm* — Locke Lord LLP; Tim Tingkang Xia, Esq.

(57) ABSTRACT

An adjustable bed system includes first and second frames; a back lifting assembly having a back lifting bracket pivotally connected to the first frame and a back lifting actuator pivotally connected between the back lifting bracket and the first frame for operably driving the back lifting bracket to pivotally move in an upward or downward rotating direction relative to the first frame; a leg lifting assembly having a leg lifting bracket pivotally connected to the second frame structure and a leg lifting actuator pivotally connected between the leg lifting bracket and the second frame for operably driving the leg lifting bracket to pivotally move in an upward or downward rotating direction relative to the second frame; and a foldable connection mechanism connecting the first and second frames such that the first and second frames are pivotally foldable relative to one another at the connection mechanism.

6 Claims, 12 Drawing Sheets

(56) References Cited

U.S. PATENT DOCUMENTS

| | | | | |
|---|---|---|---|---|
| 2012/0047650 | A1* | 3/2012 | Lin | A47C 19/122 5/400 |
| 2012/0222216 | A1* | 9/2012 | Jin | A47C 19/122 5/400 |
| 2013/0276228 | A1* | 10/2013 | Hsieh | A47C 19/122 5/400 |
| 2013/0312185 | A1* | 11/2013 | Suh | A47C 20/043 5/618 |
| 2017/0119166 | A1* | 5/2017 | An | A47C 17/40 |
| 2017/0325592 | A1* | 11/2017 | Suh | A47C 17/04 |
| 2018/0014656 | A1* | 1/2018 | Guohong | A47C 19/025 |
| 2019/0223609 | A1* | 7/2019 | Sherman | A47C 27/14 |
| 2020/0237105 | A1* | 7/2020 | Eskridge, III | A47C 27/14 |

* cited by examiner

170

170

FOLDABLE CONNECTION MECHANISM AND ADJUSTABLE BED SYSTEM THEREWITH

CROSS-REFERENCE TO RELATED PATENT APPLICATIONS

This application is a divisional application of U.S. patent application Ser. No. 16/747,842 filed Jan. 21, 2020, now allowed, which itself claims priority to and the benefit of U.S. Provisional Patent Application Ser. Nos. 62/796,154 filed Jan. 24, 2019 and 62/796,172 filed Jan. 24, 2019, and also is a continuation-in-part of U.S. patent application Ser. No. 16/729,700 filed Dec. 30, 2019, which claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

FIELD OF THE INVENTION

The invention generally relates to a bed, and more particular to foldable connection mechanisms and adjustable bed systems with the foldable connection mechanisms.

BACKGROUND OF THE INVENTION

Sleep is critical for people in every aspect of their lives. Beds are necessary furniture for people to sleep on. A conventional bed usually occupy a relatively large area of the living space for people, and also is not convenient to carry. Thus, it is beneficial and desirable for people to have a bed system that is foldable so as to reduce the space for storage and transportation. In addition, it is also beneficial and desirable that the bed system is capable of adjusting body positions based on user's sleep preference so that the user achieves maximum comfort during sleep.

SUMMARY OF THE INVENTION

In one aspect, the invention relates to a foldable connection mechanism used in an adjustable bed system having a first frame and a second frame comprising at least one connecting bracket assembly. Each connecting bracket assembly has a latch; and a first hinge bracket having a first end portion and a second end portion, and a second hinge bracket having a first end portion and a second end portion, wherein the first hinge bracket and the second hinge bracket are pivotally connected to one another through a pivot at the first ends, and each of the first hinge bracket and the second hinge bracket has a groove defined in the second end portion of said hinge bracket.

In use, the first hinge bracket and the second hinge bracket are respectively mounted on two adjacent end portions of the first frame and the second frame of the adjustable bed system such that when the latch is received in the grooves of the first hinge bracket and the second hinge bracket, the first frame and the second frame are locked and aligned in the same plane, and when the latch is off at least one of the grooves of the first hinge bracket and the second hinge bracket, the first frame and the second frame are unlocked and pivotally foldable to each other through the pivot.

In one embodiment, each connecting bracket assembly further comprises a frame mounting bracket having a body and two end tabs vertically extended from the body, and two protrusions outwards protruded from the two end tabs, respectively. In use, the body of the frame mounting bracket is mounted on one of the first frame and the second frame proximal to a corresponding one of the first hinge bracket and the second hinge bracket.

In one embodiment, the latch comprises a pin and a tab having a first end vertically attached to a first end of the pin and a second end portion defining a notch. In use, when the pin is placed in the grooves of the first hinge bracket and the second hinge bracket and the tab is positioned such that the proximal protrusion of the frame mounting bracket is received in the notch, the first frame and the second frame are locked and aligned in the same plane, and when the pin is off at least one of the grooves of the first hinge bracket and the second hinge bracket the tab is positioned such that the distal protrusion of the frame mounting bracket is received in the notch, the first frame and the second frame are unlocked and pivotally foldable to each other through the pivot.

In another aspect, the invention relates to an adjustable bed system comprising a base frame structure having a first frame and a second frame, and a foldable connection mechanism connecting the first frame and the second frame such that the first frame and the second frame are pivotally foldable relative to one another at the foldable connection mechanism. The foldable connection mechanism comprises at least one connecting bracket assembly, Each connecting bracket assembly has a latch; and a first hinge bracket having a first end portion and a second end portion, and a second hinge bracket having a first end portion and a second end portion, wherein the first hinge bracket and the second hinge bracket are pivotally connected to one another through a pivot at the first ends, and each of the first hinge bracket and the second hinge bracket has a groove defined in the second end portion of said hinge bracket.

In use, the first hinge bracket and the second hinge bracket are respectively mounted on two adjacent end portions of the first frame and the second frame of the adjustable bed system such that when the latch is received in the grooves of the first hinge bracket and the second hinge bracket, the first frame and the second frame are locked and aligned in the same plane, and when the latch is off at least one of the grooves of the first hinge bracket and the second hinge bracket, the first frame and the second frame are unlocked and pivotally foldable to each other through the pivot.

In one embodiment, each connecting bracket assembly further comprises a frame mounting bracket having a body and two end tabs vertically extended from the body, and two protrusions outwards protruded from the two end tabs, respectively. In use, the body of the frame mounting bracket is mounted on one of the first frame and the second frame proximal to a corresponding one of the first hinge bracket and the second hinge bracket.

In one embodiment, the latch comprises a pin and a tab having a first end vertically attached to a first end of the pin and a second end portion defining a notch. In use, when the pin is placed in the grooves of the first hinge bracket and the second hinge bracket and the tab is positioned such that the proximal protrusion of the frame mounting bracket is received in the notch, the first frame and the second frame are locked and aligned in the same plane, and when the pin is off at least one of the grooves of the first hinge bracket and the second hinge bracket the tab is positioned such that the distal protrusion of the frame mounting bracket is received in the notch, the first frame and the second frame are unlocked and pivotally foldable to each other through the pivot.

In one embodiment, each of the first and second frames includes a pair of side rails being transversely spaced and longitudinally extended and being parallel to each other, each side rail having a first end and an opposite, second end, and an upper rail and a lower rail being longitudinally spaced and transversely extended. Two ends of the upper rail are rigidly connected to the first ends of the pair of side rails, and two ends of the lower rail are rigidly connected to the second ends of the pair of side rails, such that the upper rail and the lower rail and the pair of side rails are co-planar in a rectangle form.

In one embodiment, the adjustable bed system further comprises at least one of a back lifting assembly and a leg lifting assembly.

The back lifting assembly includes a back lifting bracket pivotally connected to the first frame, and at least one back lifting actuator pivotally connected between the back lifting bracket and the first frame for operably driving the back lifting bracket to pivotally move in an upward rotating direction or a downward rotating direction relative to the first frame.

The leg lifting assembly includes a leg lifting bracket pivotally connected to the second frame structure, and at least one leg lifting actuator pivotally connected between the leg lifting bracket and the second frame for operably driving the leg lifting bracket to pivotally move in an upward rotating direction or a downward rotating direction relative to the second frame.

In one embodiment, the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the first frame and the second end portion of the activation rod pivotally connected to the back lifting bracket, or wherein the motor member is pivotally connected to the back lifting bracket and the second end portion of the activation rod pivotally connected to the first frame.

In one embodiment, the at least one leg lifting actuator comprises the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the second frame and the second end portion of the activation rod pivotally connected to the leg lifting bracket, or wherein the motor member is pivotally connected to the leg lifting bracket and the second end portion of the activation rod pivotally connected to the second frame.

In one embodiment, the adjustable bed system also includes a plurality of platforms disposed on the base frame structure and coupled with the back lifting assembly and the leg lifting assembly such that positions of at least one or more of the plurality of platforms are adjustable in accordance with operations of the back lifting assembly and the leg lifting assembly.

In one embodiment, the plurality of platforms comprises at least one seat platform and mounted on the two side rails of the base frame structure, a back platform coupled to the back lifting assembly, such that the back platform is operably rotatable around its lower edge in a back platform downward rotating direction or a back platform upward rotating direction, and a thigh platform and a leg platform coupled to the led lifting assembly, such that the thigh platform is rotatable around its upper edge in a thigh platform downward rotating direction or a thigh platform upward rotating direction, and the leg platform is rotatable around its upper edge in a leg platform downward rotating direction or a led platform upward rotating direction.

In one embodiment, the adjustable bed system also includes a controller configured to control operations of the at least one back lifting actuator and the at least one leg lifting actuator, respectively, so as to lift individually or cooperatively the back platform, the thigh platform, and the leg platform in desired positions.

In yet another aspect, the invention relates to a foldable connection mechanism used in an adjustable bed system having a first frame and a second frame comprising at least one connecting bracket. Each connecting bracket comprises a top portion, and a first side portion and a second side portion vertically extended from two opposite sides of the top portion so as to define a notched receptacle between the top portion, the first side portion and the second side portion, wherein the first side portion has two through holes spatial-apart formed therein, wherein in use, two adjacent end portions of the first frame and the second frame of the adjustable bed system are received in the notched receptacle and pivotally connected to the connecting bracket through the two through holes respectively.

In one embodiment, each connecting bracket further comprises a tab transversely extended from the second side so that the tab is parallel to the top portion, wherein the tab has a middle portion, a first flange and a second flange extended oppositely from two sides of the middle portion so that the first flange and the second flange are co-planar, and the middle portion is positioned between the first/second flange and the top portion of the connecting bracket. The middle portion of the tab has a mounting hole defined therein In one aspect, the invention relates to an adjustable bed system. In one embodiment, the adjustable bed system includes a base frame structure, a back lifting assembly, a leg lifting assembly, and a foldable connection mechanism.

In one embodiment, the base frame structure has a first frame and a second frame.

The back lifting assembly includes a back lifting bracket pivotally connected to the first frame, and at least one back lifting actuator pivotally connected between the back lifting bracket and the first frame for operably driving the back lifting bracket to pivotally move in an upward rotating direction or a downward rotating direction relative to the first frame.

The leg lifting assembly includes a leg lifting bracket pivotally connected to the second frame structure, and at least one leg lifting actuator pivotally connected between the leg lifting bracket and the second frame for operably driving the leg lifting bracket to pivotally move in an upward rotating direction or a downward rotating direction relative to the second frame.

The foldable connection mechanism connects the first frame and the second frame such that the first frame and the second frame are pivotally foldable relative to one another at the foldable connection mechanism.

In one embodiment, each of the first and second frames includes a pair of side rails being transversely spaced and longitudinally extended and being parallel to each other, each side rail having a first end and an opposite, second end, and an upper rail and a lower rail being longitudinally spaced and transversely extended. Two ends of the upper rail are rigidly connected to the first ends of the pair of side rails, and two ends of the lower rail are rigidly connected to the second ends of the pair of side rails, such that the upper rail and the lower rail and the pair of side rails are co-planar in a rectangle form.

In one embodiment, the foldable connection mechanism comprises at least one connecting bracket comprising a top portion, and a first side portion and a second side portion vertically extended from two opposite sides of the top portion so as to define a notched receptacle between the top portion, the first side portion and the second side portion, wherein the first side portion has two through holes spatial-apart formed therein.

In one embodiment, as assembled, two connecting bracket are used, the second ends of the pair of side rails of the first frame are respectively received in the notched receptacles of the two connecting brackets and pivotally and respectively connected to the two connecting brackets through one of the two through holes of each connecting bracket, and the first ends of the pair of side rails of the second frame are respectively received in the notched receptacles of the two connecting bracket and pivotally and respectively connected to the two connecting brackets through the other of the two through holes of each connecting bracket.

In one embodiment, the connecting bracket further comprises a tab transversely extended from the second side so that the tab is parallel to the top portion, wherein the tab has a middle portion, a first flange and a second flange extended oppositely from two sides of the middle portion so that the first flange and the second flange are co-planar, and the middle portion is positioned between the first/second flange and the top portion of the connecting bracket.

In one embodiment, the middle portion of the tab has a mounting hole defined therein.

In one embodiment, the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the first frame and the second end portion of the activation rod pivotally connected to the back lifting bracket, or wherein the motor member is pivotally connected to the back lifting bracket and the second end portion of the activation rod pivotally connected to the first frame.

In one embodiment, the at least one leg lifting actuator comprises the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the second frame and the second end portion of the activation rod pivotally connected to the leg lifting bracket, or wherein the motor member is pivotally connected to the leg lifting bracket and the second end portion of the activation rod pivotally connected to the second frame.

In one embodiment, the adjustable bed system also includes a plurality of platforms disposed on the base frame structure and coupled with the back lifting assembly and the leg lifting assembly such that positions of at least one or more of the plurality of platforms are adjustable in accordance with operations of the back lifting assembly and the leg lifting assembly.

In one embodiment, said at least one or more of the plurality of platforms have a plurality of openings.

In one embodiment, the plurality of platforms comprises at least one seat platform and mounted on the two side rails of the base frame structure, a back platform coupled to the back lifting assembly, such that the back platform is operably rotatable around its lower edge in a back platform downward rotating direction or a back platform upward rotating direction, and a thigh platform and a leg platform coupled to the led lifting assembly, such that the thigh platform is rotatable around its upper edge in a thigh platform downward rotating direction or a thigh platform upward rotating direction, and the leg platform is rotatable around its upper edge in a leg platform downward rotating direction or a led platform upward rotating direction.

In one embodiment, the adjustable bed system further includes at least one leg support member having one end pivotally connected to at least one of the pair of side rails of the second frame through a pivot, and the other end coupled to the leg platform.

In one embodiment, the adjustable bed system also includes a controller configured to control operations of the at least one back lifting actuator and the at least one leg lifting actuator, respectively, so as to lift individually or cooperatively the back platform, the thigh platform, and the leg platform in desired positions.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
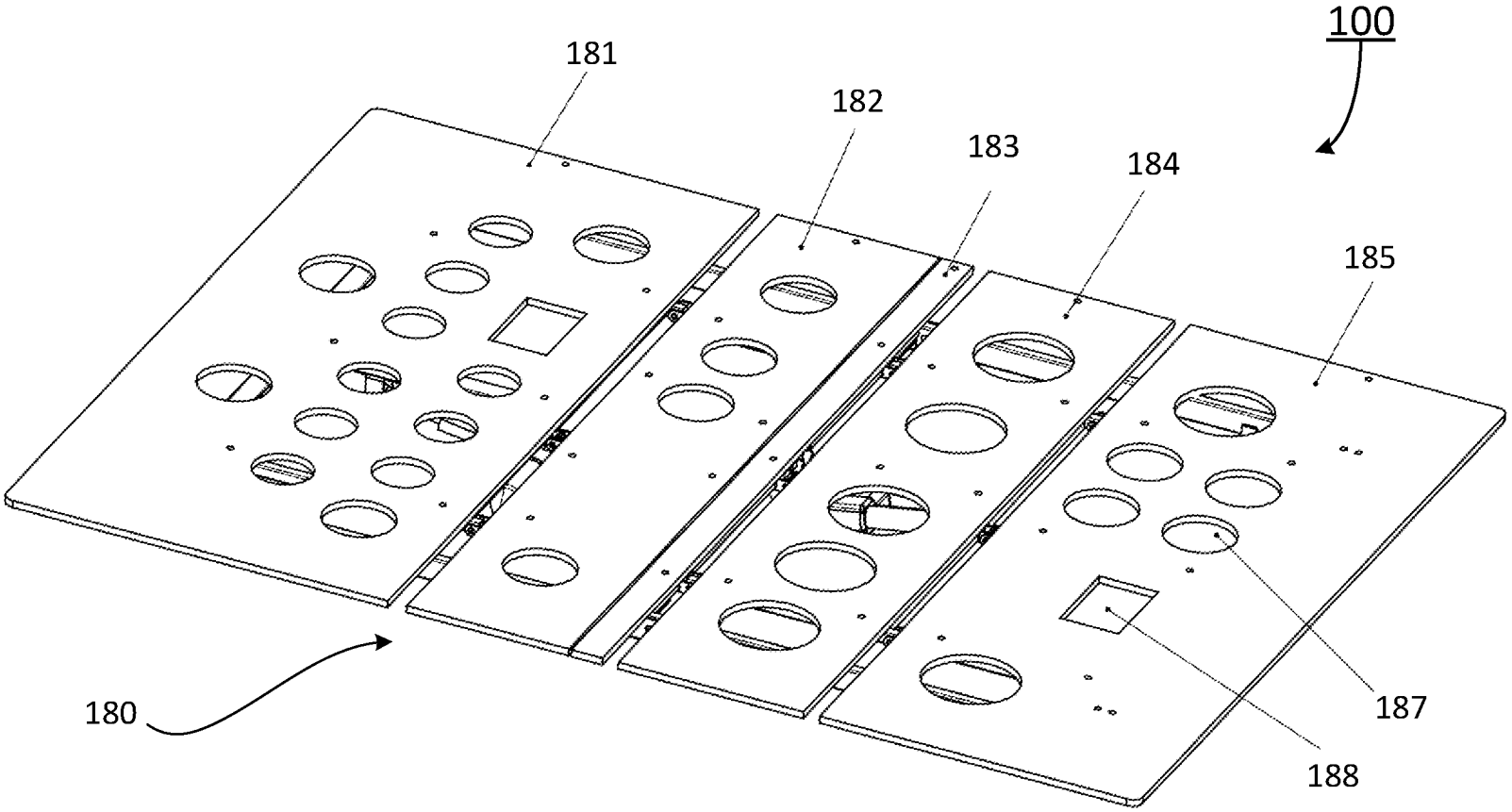
FIG. 1 shows schematically a front perspective view of an adjustable bed system with bed platforms/boards in a plane state according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-11. In accordance with the purposes of this invention, as embodied and broadly described herein, this invention, in one aspect, relates to an adjustable bed system with a foldable connection mechanism.

Figure 2:
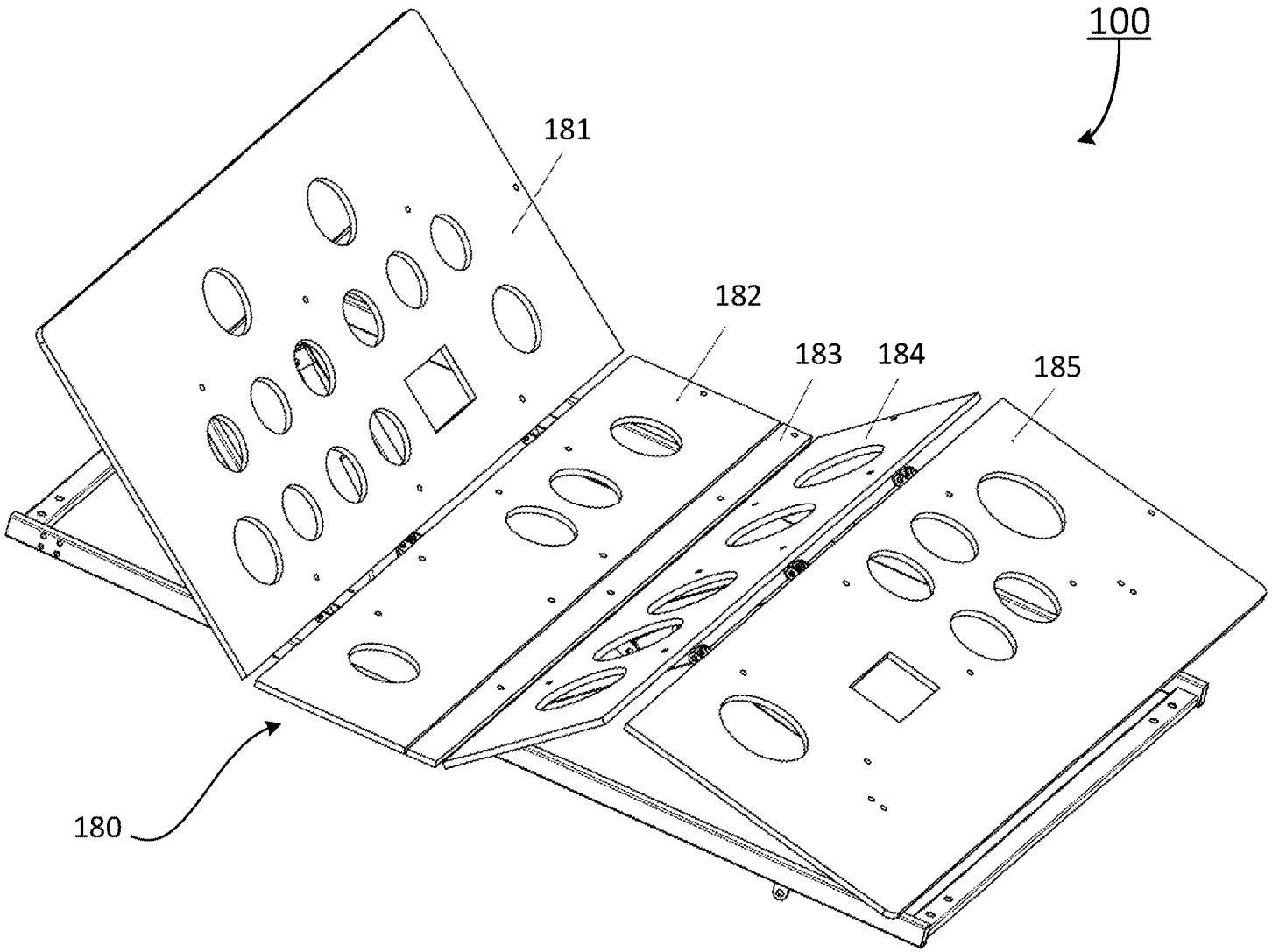
FIG. 2 shows schematically a front perspective view of the adjustable bed system shown in FIG. 1 in an adjusted state.
Figure 3:
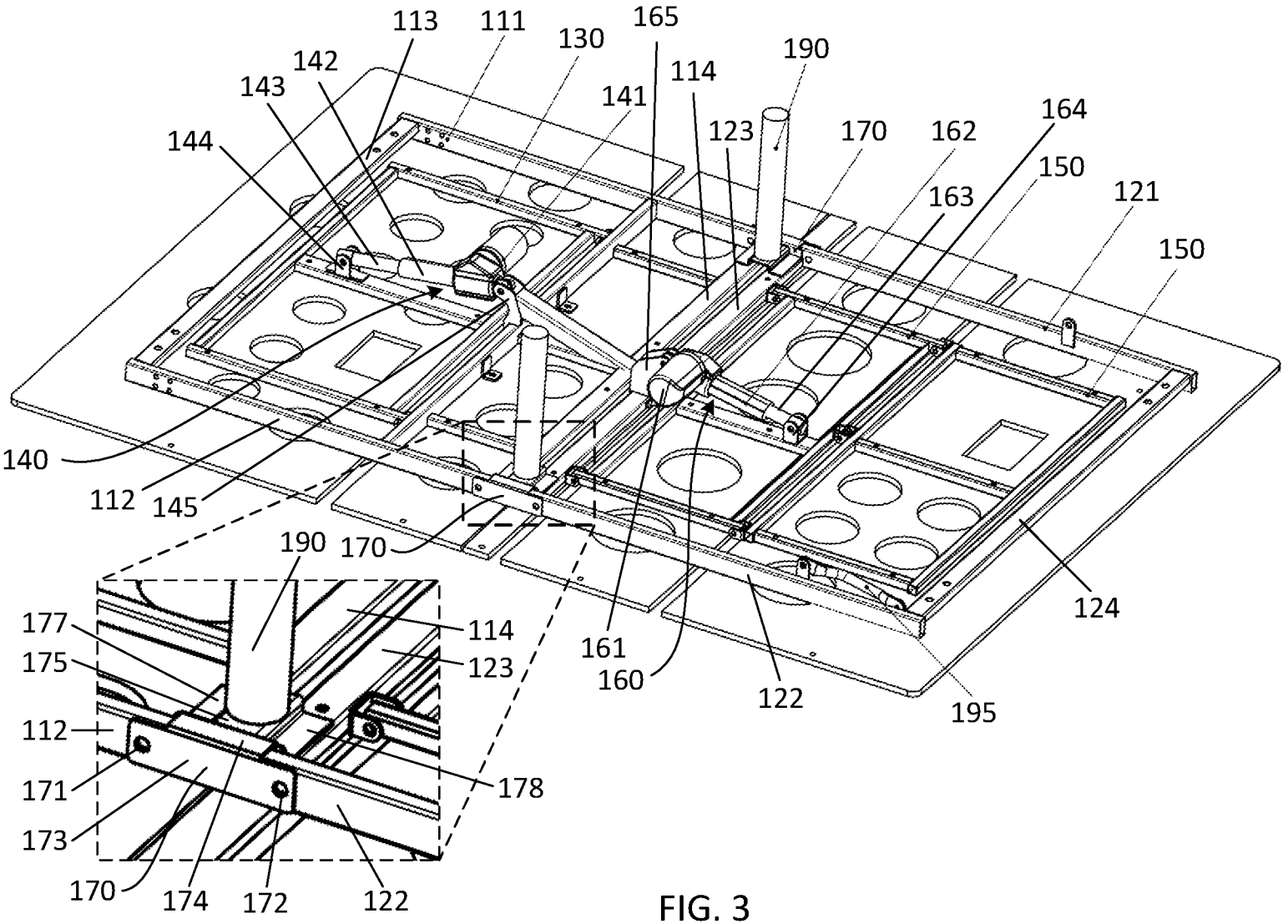
FIG. 3 shows schematically a back perspective view of the adjustable bed system shown in FIG. 1 in the plane state.
Figure 4:
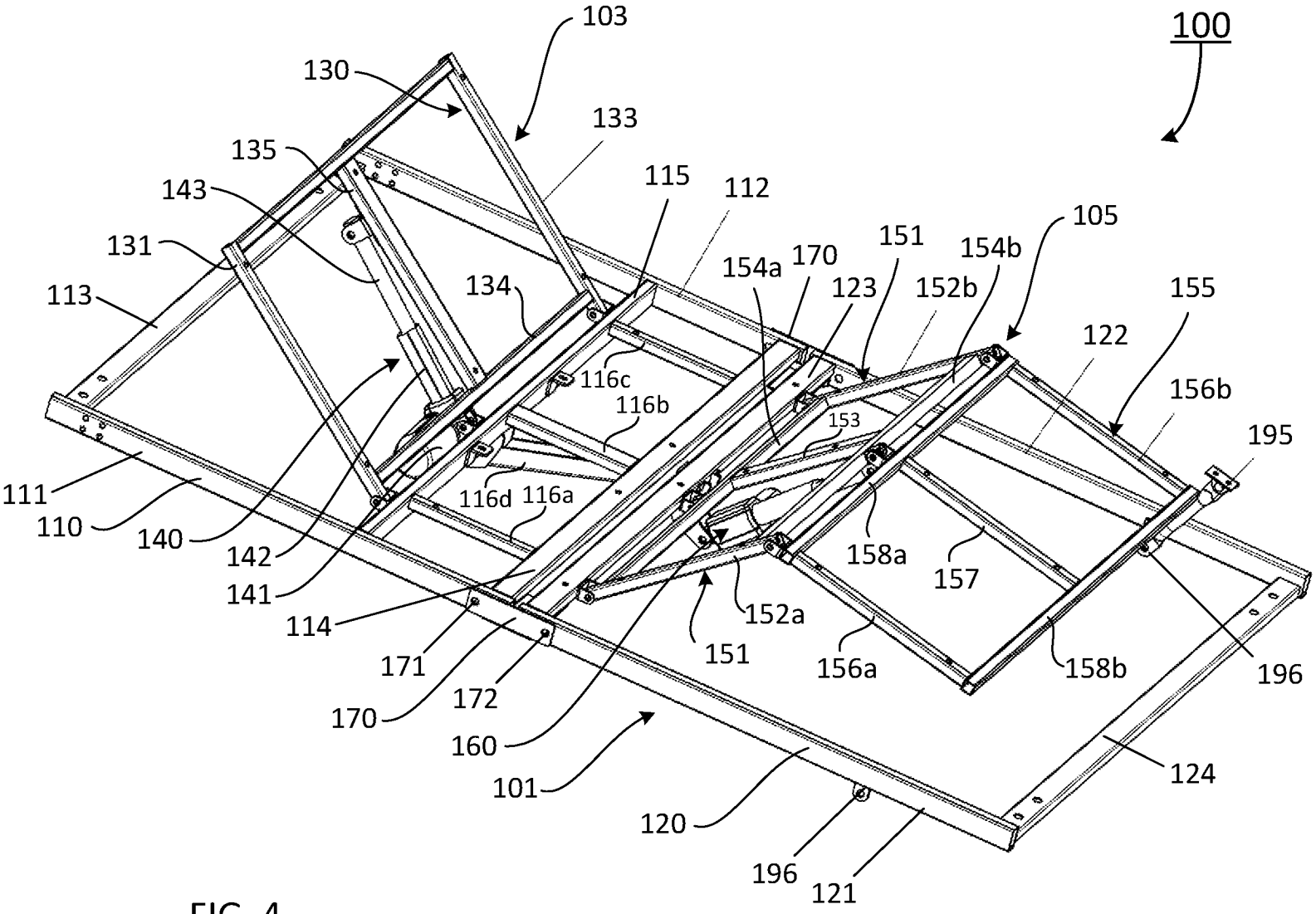
FIG. 4 shows schematically a front perspective view of the adjustable bed system shown in FIG. 1 in the adjusted state (platforms are not shown).

Referring to FIGS. 1-7, and particularly to FIGS. 3-5, the adjustable bed system 100 includes a base frame structure 101, a back lifting assembly 103, a leg lifting assembly 105, and a foldable connection mechanism 170.

In this exemplary embodiment shown FIGS. 1-7, the base frame structure 101 has a first frame 110 and a second frame 120.

The first frame 110 includes a pair of side rails 111 and 112 being transversely spaced and longitudinally extended and being parallel to each other, and an upper rail 113 and a lower rail 114 being longitudinally spaced and transversely extended. Each side rail 111/112 has a first end and an opposite, second end. Two ends of the upper rail 113 are rigidly connected to the first ends of the pair of side rails 111 and 112, respectively, and two ends of the lower rail 114 are rigidly connected to the second ends of the pair of side rails 111 and 112, respectively. As such the upper rail 113 and the lower rail 114 and the pair of side rails 111 and 112 are co-planar in a rectangle form. In addition, the first frame 110 may optionally include a middle rail 115 locating between the upper rail 113 and the lower rail 114, and having two ends being rigidly connected to the pair of side rails 111 and 112. Optionally, the first frame 110 may also have a plurality of frame reinforcement bars 116*a*, 116*b*, 116*c* and 116*d* being rigidly connected to the lower rail 114 and the middle rail 115, as shown in FIG. 4.

The second frame 120 includes a pair of side rails 121 and 122 being transversely spaced and longitudinally extended and being parallel to each other, and an upper rail 123 and a lower rail 124 being longitudinally spaced and transversely extended. Each side rail 121/112 has a first end and an opposite, second end. Two ends of the upper rail 123 are rigidly connected to the first ends of the pair of side rails 121 and 122, respectively, and two ends of the lower rail 124 are rigidly connected to the second ends of the pair of side rails 121 and 122, respectively. As such, the upper rail 123 and the lower rail 124 and the pair of side rails 121 and 122 are co-planar in a rectangle form.

The back lifting assembly 103 includes a back lifting bracket 130 pivotally connected to the first frame 110, and at least one back lifting actuator 140 pivotally connected between the back lifting bracket 130 and the first frame 110 for operably driving the back lifting bracket 130 to pivotally move in an upward rotating direction or a downward rotating direction relative to the first frame 110.

In this exemplary embodiment shown FIGS. 1-7, the back lifting bracket 130 includes two arms 131 and 132 and a reinforcement bar 135 being transversely spaced and longitudinally extended, an upper bar 133 and a lower bar 134 being longitudinally spaced and transversely extended. The first ends of the two arms 131 and 132 are rigidly connected to the upper bar 133 and the second ends of the two arms 131 and 132 are pivotally connected to the middle rail 115 of the first frame 110. The lower bar 134 is rigidly connected to the two arms 131 and 132 at positions proximal to the second ends of the two arms 131 and 132, and the reinforcement bar 135 is rigidly connected to the middles of the upper bar 133 and the lower bar 134.

In some embodiments, the back lifting bracket may be designed in other forms. For example, as disclosed in U.S. patent application Ser. No. 16/729,700, filed Dec. 30, 2019, which is incorporated herein in its entirety by reference, the back lifting bracket has a middle bar and a pair of swing arms. The pair of swing arms is transversely spaced and longitudinally extended, and rigidly connected to ends of the transversely extending middle bar in an H-shaped form. Each of the pair of swing arms has a first end portion and an opposite, second end portion, where the first end portions of the pair of swing arms are pivotally connected to the two side rails of the first frame, respectively.

In this exemplary embodiment shown FIGS. 1-7, the at least one back lifting actuator 140 comprises a motor member 141, an outer tube 142 extending from the motor member 141, and an activation rod 143 having a first end portion received in the outer tube 142 and an opposite, second end portion. The activation rod 143 is engaged with the motor member 141 and configured to be telescopically movable relative to the outer tube 142 according to a direction of motor rotation. The motor member 141 is pivotally connected to the first frame 110, for example, to the middle rail 115 of the first frame 110 through a bracket 145. The second end portion of the activation rod 143 is pivotally connected to the back lifting bracket 130, for example, to the reinforcement bar 135 through a bracket 144.

In some embodiments, the motor member 141 can be pivotally connected to the back lifting bracket 130 and the second end portion of the activation rod 143 pivotally connected to the first frame 110.

The leg lifting assembly 105 includes a leg lifting bracket 150 pivotally connected to the second frame structure 120, and at least one leg lifting actuator 160 pivotally connected between the leg lifting bracket 150 and the second frame 120 for operably driving the leg lifting bracket 150 to pivotally move in an upward rotating direction or a downward rotating direction relative to the second frame 120.

In this exemplary embodiment shown FIGS. 1-7, the leg lifting bracket 150 has a first lifting bracket 151 and a second lifting bracket 155 pivotally connected to the first lifting bracket 151. The first lifting bracket 151 includes two arms 152*a* and 152*b* and a reinforcement bar 153 being transversely spaced and longitudinally extended, an upper bar 154*a* and a lower bar 154*b* being longitudinally spaced and transversely extended. The first ends of the two arms 152*a* and 152*b* are pivotally connected to the upper rail 123 of the second frame 120. The lower bar 154*b* is rigidly connected to the two arms 152*a* and 152*b* at positions proximal to the second ends of the two arms 152*a* and 152*b*. The upper bar 154*a* is rigidly connected to the two arms 152*a* and 152*b* at positions proximal to the first ends of the two arms 152*a* and 152*b*, and the reinforcement bar 153 is rigidly connected to the middles of the upper bar 154*a* and the lower bar 154*b*.

The second lifting bracket 155 has two arms 156*a* and 156*b* and a reinforcement bar 157 being transversely spaced and longitudinally extended, an upper bar 158*a* and a lower bar 158*b* being longitudinally spaced and transversely extended. The first ends of the two arms 156*a* and 156*b* are pivotally connected to the second ends of the two arms 152*a* and 152*b* of the first lifting bracket 151, respectively. The second ends of the two arms 156*a* and 156*b* are rigidly connected to the lower bar 158*b*. The upper bar 158*a* is rigidly connected to the two arms 156*a* and 156*b* at positions proximal to the first ends of the two arms 156*a* and 156*b*, and the reinforcement bar 157 is rigidly connected to the middles of the upper bar 158*a* and the lower bar 158*b*.

In some embodiments, the leg lifting bracket may be designed in other forms. For example, as disclosed in U.S. patent application Ser. No. 16/729,700, filed Dec. 30, 2019, which is incorporated herein in its entirety by reference, the back lifting bracket has a middle bar and a pair of swing arms. The pair of swing arms is transversely spaced and longitudinally extended, and rigidly connected to ends of the transversely extending middle bar in an H-shaped form. Each of the pair of swing arms has a first end portion and an opposite, second end portion, where the first end portions of the pair of swing arms are pivotally connected to the two side rails of the first frame, respectively.

In this exemplary embodiment shown FIGS. 1-7, the at least one back lifting actuator 160 comprises a motor member 161, an outer tube 162 extending from the motor member 161, and an activation rod 163 having a first end portion received in the outer tube 162 and an opposite, second end portion. The activation rod 163 is engaged with the motor member 161 and configured to be telescopically movable relative to the outer tube 162 according to a direction of motor rotation. The motor member 161 is pivotally connected to the second frame 120, for example, to the upper rails 123 of the second frame 120. The second end portion of the activation rod 163 pivotally connected to the leg lifting bracket 150, for example, to the reinforcement bar 153 of the first lifting bracket 151 of the leg lifting bracket 150.

In some embodiments, the motor member 161 may be pivotally connected to the leg lifting bracket 130 and the second end portion of the activation rod 163 pivotally connected to the second frame 120.

In this exemplary embodiment shown FIGS. 1-7, the foldable connection mechanism 170 is used to connect the first frame 110 and the second frame 120 such that the first frame 110 and the second frame 120 are pivotally foldable relative to one another at the foldable connection mechanism 170.

Figure 5A:
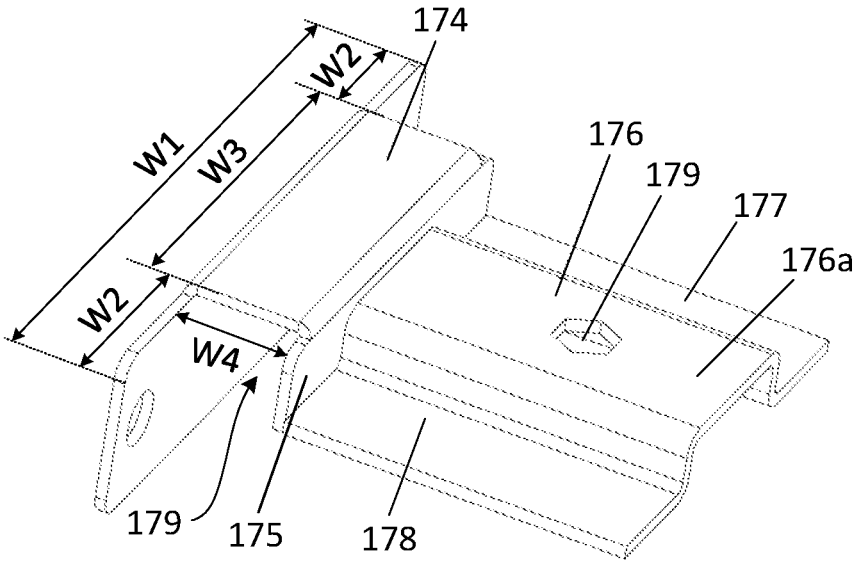
FIGS. 5A-5B shows schematically two perspective views of a connection mechanism used for an adjustable bed system, according to one embodiment of the invention.
Figure 5B:
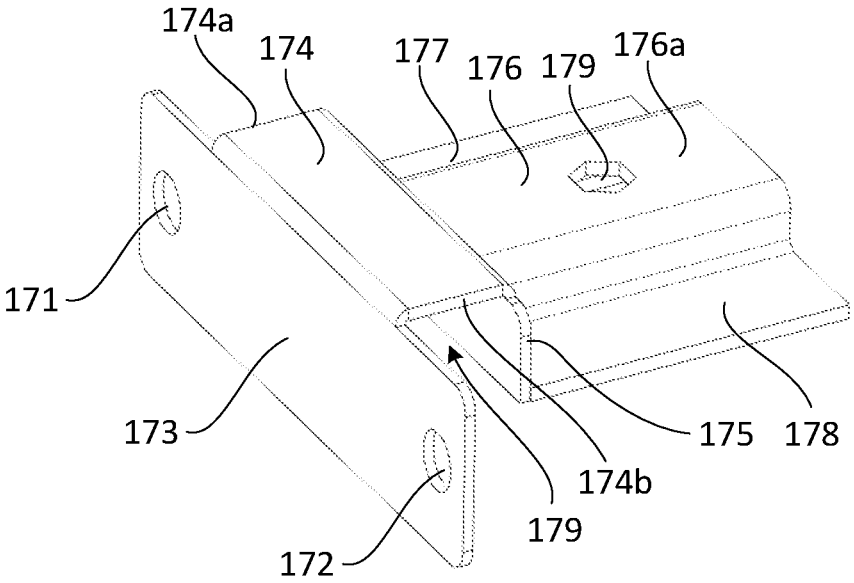

As shown FIGS. 5A-5B, in one embodiment, the foldable connection mechanism 170 comprises a pair of connecting brackets 170. Each connecting bracket 170 has a top portion 174, and a first side portion 173 and a second side portion 175 vertically extended from two opposite sides of the top portion 174 so as to define a notched receptacle 179 between the top portion 174, the first side portion 173 and the second side portion 175. The first side portion 173 has two through holes 171 and 172 spatial-apart formed therein. The first side portion 173 has a width W1 and the top portion 175 has a width W3, where W1 is greater than W3, so that beyond the top portion width W3, the first side portion 173 has two areas with each having a width W2. Practically, the two through holes 171 and 172 are located in the two W2 areas, respectively. The notched receptacle 179 has a width W4.

In addition, the connecting bracket 170 further comprises a tab 176 transversely extended from the second side 175 so that the tab 176 is parallel to the top portion 174. The tab 176 has a middle portion 176*a*, a first flange 177 and a second flange 178 extended oppositely from two sides of the middle portion 176*a* so that the first flange 177 and the second flange 178 are co-planar, and the middle portion 176*a* is positioned between the first/second flange 177/178 and the top portion 174 of the connecting bracket 170. The middle portion 176*a* of the tab 176 may a mounting hole 179 defined therein.

As shown in FIGS. 3, 4, 6 and 7, as assembled, the pair of connecting brackets 170 are used, and one connecting bracket 170 connects the second end of the side rail 111 of the first frame 110 and the first end of the side rail 121 of the second frame 120, while the other connecting bracket 170 connects the second end of the side rail 112 of the first frame 110 and the first end of the side rail 122 of the second frame 120. Specifically, the second ends of the pair of side rails 111 and 112 of the first frame 110 are respectively received in the notched receptacles 179 of the two connecting brackets 170 and pivotally and respectively connected to the two connecting brackets 170 through one of the two through holes 171 and 172 of each connecting bracket 170, and the first ends of the pair of side rails 121 and 122 of the second frame 120 are respectively received in the notched receptacles 179 of the two connecting bracket 170 and pivotally and respectively connected to the two connecting brackets 170 through the other of the two through holes 171 and 172 of each connecting bracket 170. Practically, each side rail 111, 112, 121 or 122 of the first and second frames 110 and 120 has a width that is less or slightly less than the width W4 of the notched receptacle 179 of the connecting bracket 170.

As shown in FIG. 3 and particularly the enlarged section, the first and second frames 110 and 120 are connected by the connecting brackets 170 in the plane state, such that the first end portion of the side rail 122 of the second frame 120 is received in the notched receptacle 179 of the connecting bracket 170 and pivotally connected to the first side portion 173 of the connecting brackets 170 via the through hole (a pivot) 172, while the second end portion of the side rail 112 of the first frame 110 is received in the notched receptacle 179 of the connecting bracket 170 and pivotally connected to the first side portion 173 of the connecting brackets 170 via the through hole (a pivot) 171. As such, the first and second frames 110 and 120 are connected, aligned and supported by the pair of connecting brackets 170. Meanwhile, the first flange 177 and the second flange 178 of the connecting brackets 170 are against the lower rail 114 of the first frame 110 and the upper rails 123 of the second frame 120, respectively, for providing further support to the first and second frames 110 and 120. Furthermore, a vertical support post 190 may be mounted to each connecting bracket 170 through the mounting hole 179 formed on the tab 176 of said connecting bracket 170.

Figure 6:
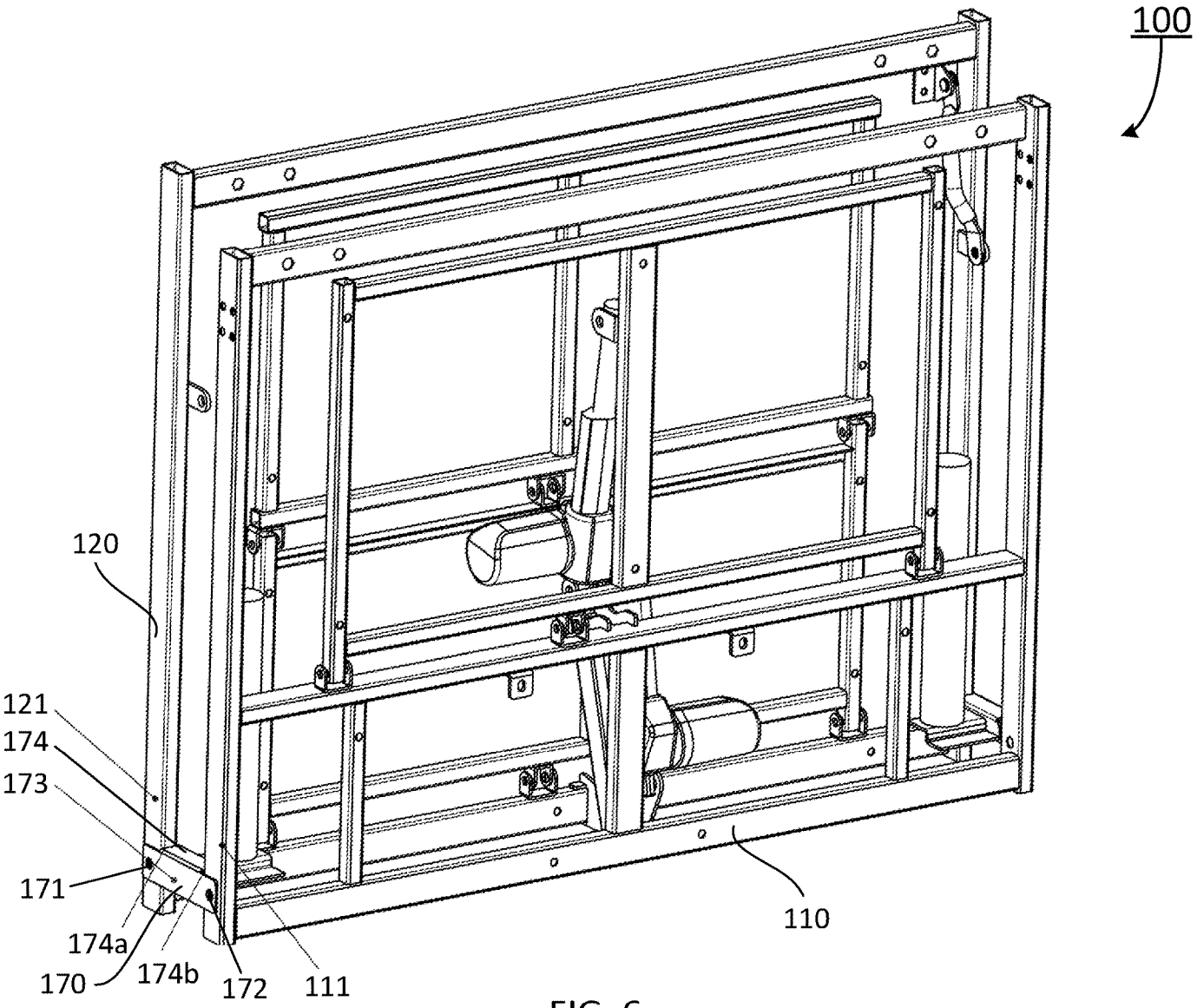
FIG. 6 shows schematically a perspective view of the adjustable bed system shown in FIG. 1 in a folded state (platforms are not shown).
Figure 7:
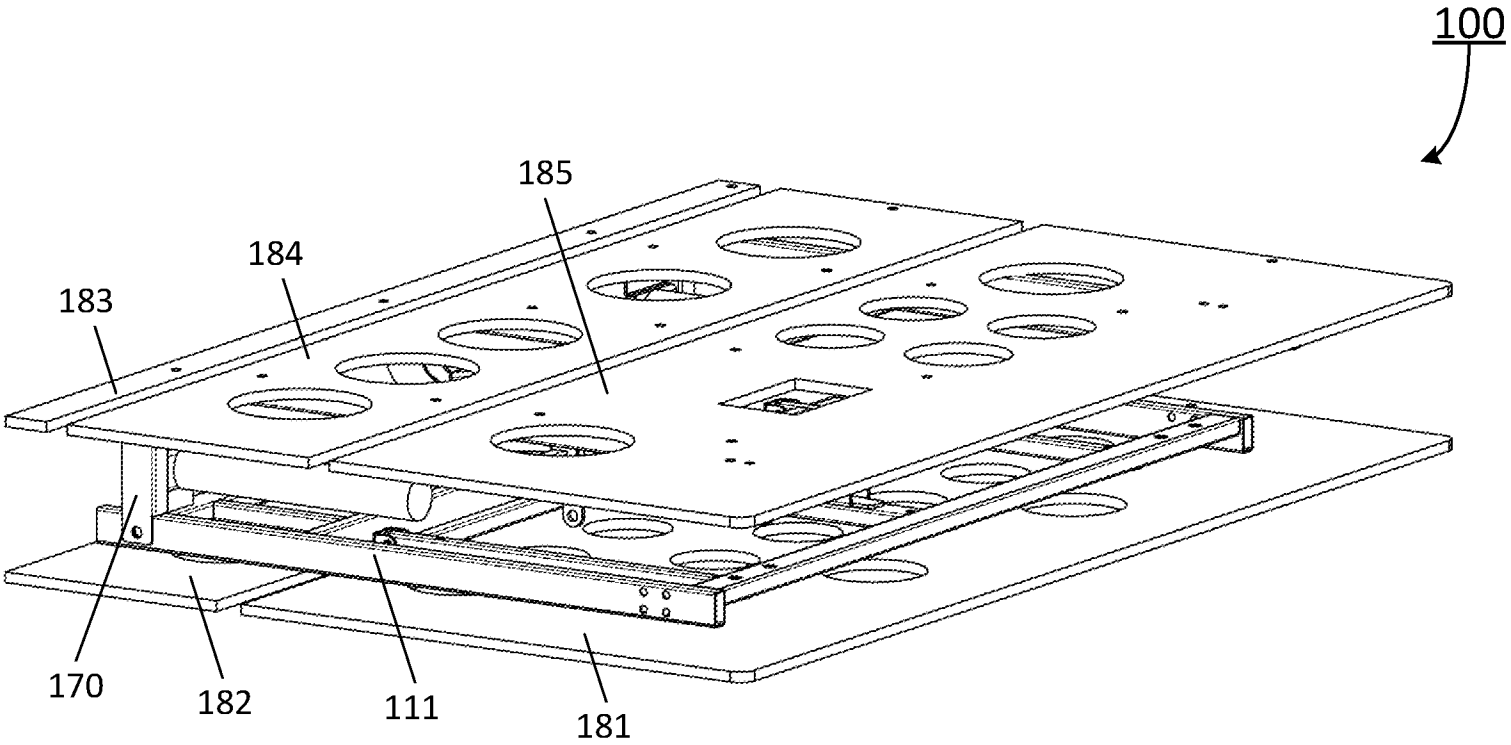
FIG. 7 shows schematically another perspective view of the adjustable bed system shown in FIG. 1 in the folded state.

Such design of the connecting bracket 170 also allows the first and second frames 110 and 120 to be pivotally foldable relative to one another at the pivots 171 and 172, respectively, so as to reduce the space for storage and transportation. FIGS. 6 and 7 show different views of the adjustable bed system in the folded state, where the side rail 111 of the first frame 110 is against the edge 174*b* of the top portion 174 of the connecting bracket 170, while the side rail 121 of the second frame 120 is against the edge 174*a* of the top portion 174 of the connecting bracket 170, and the first frame 110 and the second frame 120 are spatially apart by the width W3 of the top portion 174 of the connecting bracket 170, which provides a space for accommodating the back lifting assembly 103, the leg lifting assembly 105 and the vertical support posts 190 in the folded state.

In addition, as shown in FIGS. 1-3, the adjustable bed system 100 also includes a plurality of platforms 180 disposed on the base frame structure 101 for supporting, for example, a mattress. The plurality of platforms 180 is coupled with the back lifting assembly 103 and the leg lifting assembly 105 such that positions of at least one or more of the plurality of platforms 180 are adjustable in accordance with operations of the back lifting assembly 103 and the leg lifting assembly 105. Said at least one or more of the plurality of platforms 180 have a plurality of openings 187 and 188.

The plurality of platforms 180 includes two seat platform 182 and 183 mounted on the two side rails of the first frame 110 and/or the second frame 120 of the base frame structure 101.

The plurality of platforms 180 also includes a back platform 181 coupled to the back lifting assembly 103, such that the back platform 181 is operably rotatable around its lower edge in a back platform downward rotating direction or a back platform upward rotating direction.

The plurality of platforms 180 further includes a thigh platform 184 and a leg platform 185 coupled to the led lifting assembly 105. Specifically, the thigh platform 184 and the leg platform 185 are respectively coupled to the first leg lifting bracket 151 and the second leg lifting bracket 155, such that the thigh platform 184 is rotatable around its upper edge in a thigh platform downward rotating direction or a thigh platform upward rotating direction, and the leg platform 185 is rotatable around its upper edge in a leg platform downward rotating direction or a led platform upward rotating direction.

In one embodiment, the adjustable bed system further at least one leg support member 195 having one end pivotally connected to at least one of the pair of side rails of the second frame 120 through a pivot 196, and the other end coupled to the leg platform 185. Operably, there are a pair of leg support members 195 supporting the leg platform 185 when the leg platform 185 is lifted after the thigh platform 184 is lifted.

Furthermore, the adjustable bed system also includes a controller (not shown) configured to control operations of the at least one back lifting actuator 140 and the at least one leg lifting actuator 160, respectively, so as to lift individually or cooperatively the back platform 181, the thigh platform 184, and the leg platform 185 in desired positions, as shown in FIGS. 2 and 4.

One aspect of the invention also relates to a foldable connection mechanism used in an adjustable bed system having a first frame and a second frame as disclosed above. The foldable connection mechanism includes at least one connecting bracket assembly 270.

As shown in FIGS. 8A-8D, in one embodiment, each connecting bracket assembly 270 has a latch 277; and a first hinge bracket 271 having a first end portion 271*a* and a second end portion 271*b*, and a second hinge bracket 272 having a first end portion 272*a* and a second end portion 272*b*. The first hinge bracket 271 and the second hinge bracket 272 are pivotally connected to one another through a pivot 273 at the first ends 271*a* and 272*a*. Each of the first hinge bracket 271 and the second hinge bracket 272 has a groove 271*c*/272*c* defined in the second end portion 271*b*/272*b* of said hinge bracket 271/272.

In use, the first hinge bracket 271 and the second hinge bracket 272 are respectively mounted on two adjacent end portions of the first frame and the second frame of the adjustable bed system such that when the latch 277 is received in the grooves 271*c* and 272*c* of the first hinge bracket 271 and the second hinge bracket 272, the first frame and the second frame are locked and aligned in the same plane, and when the latch 277 is off at least one of the grooves 271*c* and 272*c* of the first hinge bracket 271 and the second hinge bracket 272, the first frame and the second frame are unlocked and pivotally foldable to each other through the pivot 273.

Figure 8C:
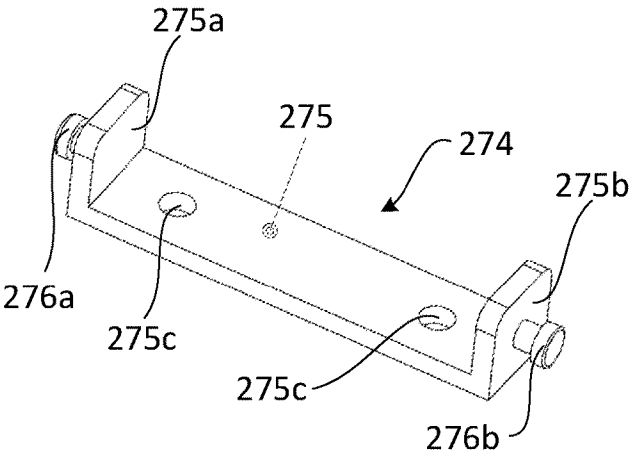
FIGS. 8A-8D show schematically different components of a connection mechanism used for an adjustable bed system according to another embodiment of the invention.

In addition, as shown in FIG. 8C, each connecting bracket assembly 270 may further have a frame mounting bracket 274 having a body 275 and two end tabs 275*a* and 275*b* vertically extended from the body, and two protrusions 276*a* and 276*b* outwards protruded from the two end tabs 275*a* and 275*b*, respectively. In use, the body 275 of the frame mounting bracket 274 is mounted on one of the first frame and the second frame proximal to a corresponding one of the first hinge bracket 271 and the second hinge bracket 272.

Figure 8D:
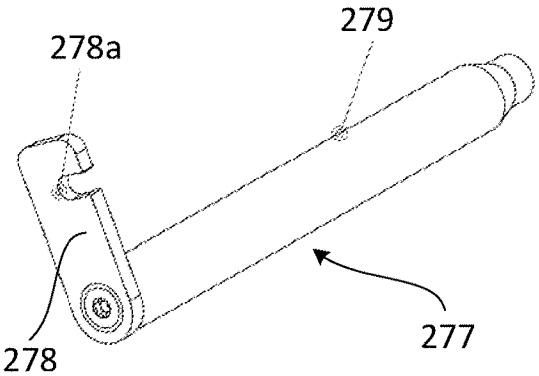
Figure 8A:
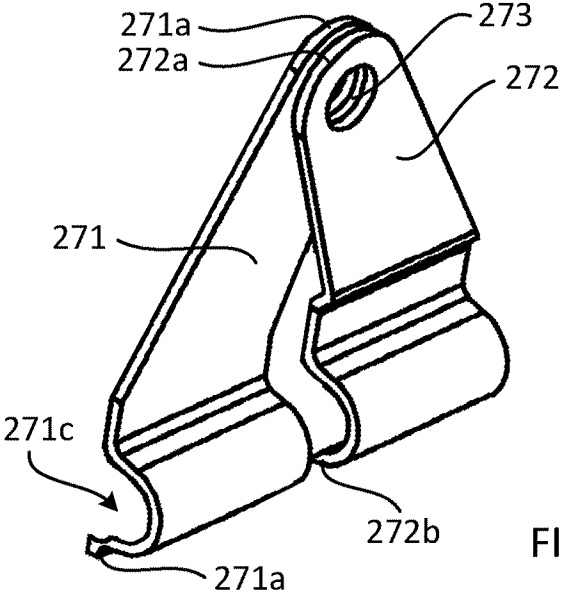
Figure 8B:
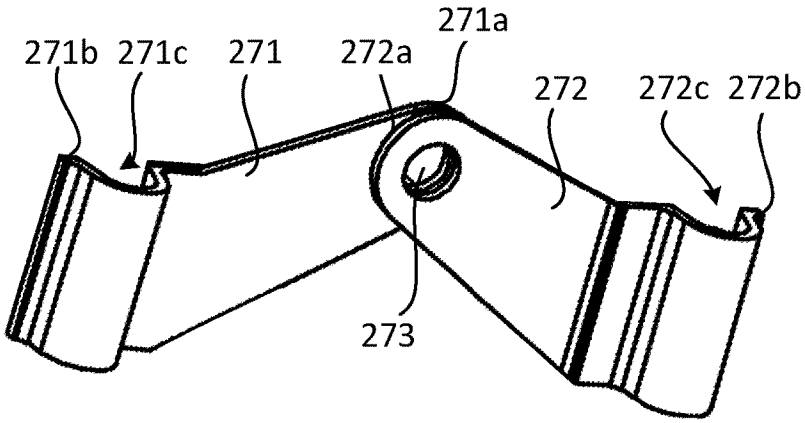

In one embodiment shown in FIG. 8D, the latch 277 may include a pin 279 and a tab 278 having a first end vertically attached to a first end of the pin 279 and a second end portion defining a notch 278*a*. In use, when the pin 279 is placed in the grooves 271*c* and 272*c* of the first hinge bracket 271 and the second hinge bracket 272 and the tab 278 is positioned such that the proximal protrusion 276*a* of the frame mounting bracket 274 is received in the notch 278*a*, the first frame and the second frame are locked and aligned in the same plane, and when the pin 279 is off at least one of the grooves 271*c* and 272*c* of the first hinge bracket 271 and the second hinge bracket 272 the tab 278 is positioned such that the distal protrusion 276*b* of the frame mounting bracket 274 is received in the notch 278*a*, the first frame and the second frame are unlocked and pivotally foldable to each other through the pivot 273.

Referring to FIGS. 9A-9D, 10 and 11 now, an adjustable bed system 200 having the connection mechanism 270 of in FIGS. 8A-8D is shown according to another embodiment of the invention. Similarly, the adjustable bed system 200 includes a base frame structure having a first frame 110 and a second frame 120, a back lifting assembly 103, a leg lifting assembly 105, a plurality of platforms/boards 180, and a foldable connection mechanism 270. In some embodiments, the first frame 110, the second frame 120, the back lifting assembly 103, the leg lifting assembly 105 and the plurality of platforms/boards 180 are identical or substantially similar to that of the adjustable bed system 100 shown in FIGS. 1-4, 6 and 7. Therefore, the detailed descriptions of them are not repeated herein.

Practically, the foldable connection mechanism 270 having a pair of connecting bracket assembly 270 is used. To be concise, the following description is given for one connecting bracket assembly 270 only.

As shown in FIGS. 9A-9D, as assembled, the first hinge bracket 271 and the second hinge bracket 272 are respectively mounted on two adjacent end portions of the first side rails 111 and 112 of the first frame 110 and the second frame 120. The body 275 of the frame mounting bracket 274 is mounted on the first side rail 111 of the first frame 110 proximal to the second hinge bracket 272.

Figure 9A:
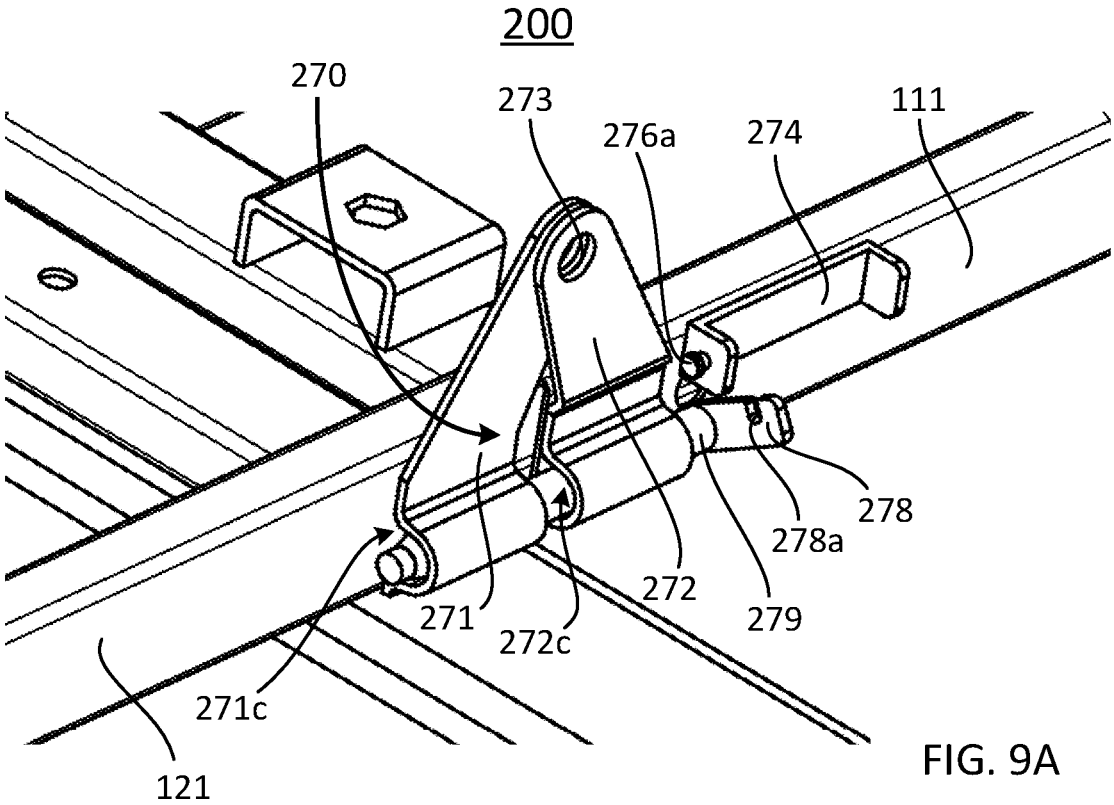
FIGS. 9A-9D show schematically partial views of an adjustable bed system having the connection mechanism shown in FIGS. 8A-8D according to another embodiment of the invention.
Figure 9B:
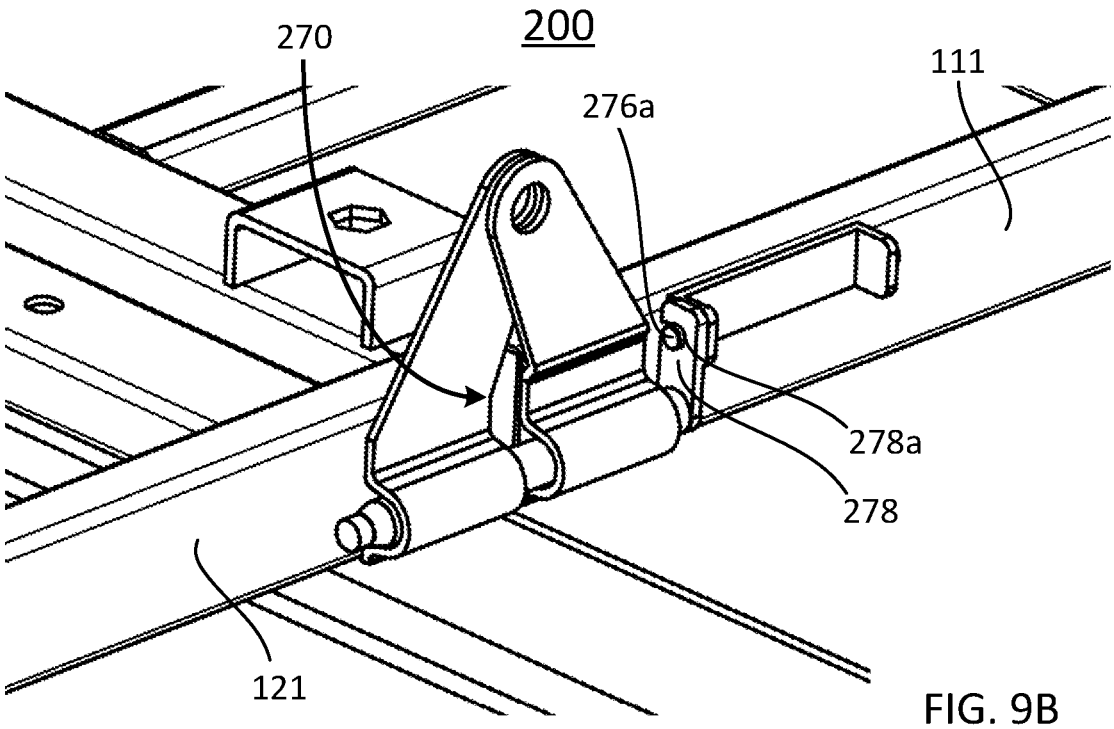

In operation, the pin 279 is placed in the grooves 271*c* and 272*c* of the first hinge bracket 271 and the second hinge bracket 272 and the tab 278 is adjusted (FIG. 9A) and positioned so that the proximal protrusion 276*a* of the frame mounting bracket 274 is received in the notch 278*a* (FIG. 9B), the side rail 111 of the first frame 120 and the side rail 121 of the second frame 120 are locked and aligned in the same plane, as shown in FIG. 9B. Accordingly, the adjustable bed system 200 is in the plane state and ready for use.

Figure 9D:
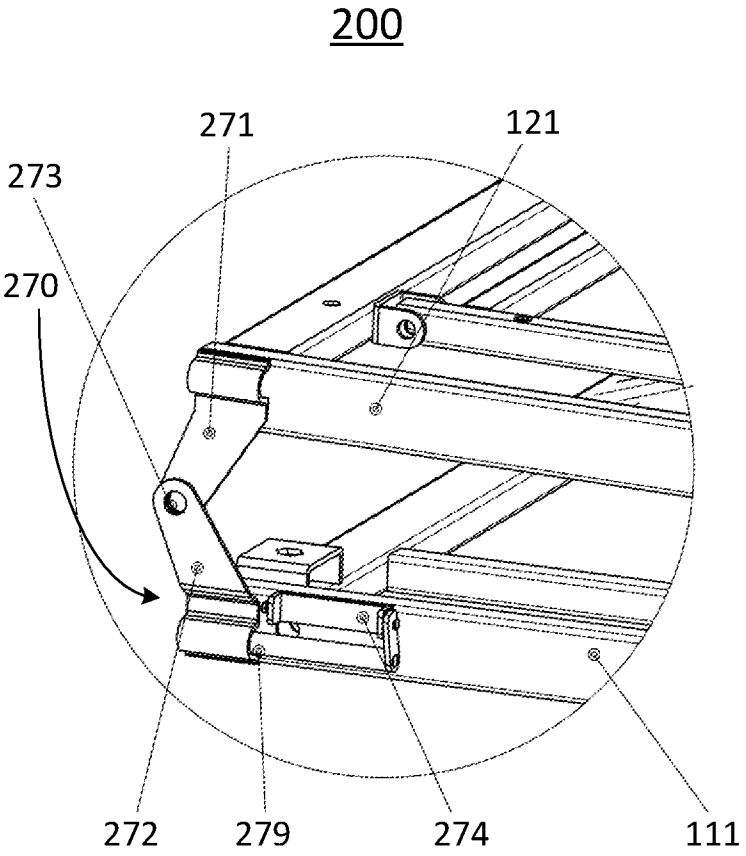
Figure 9C:
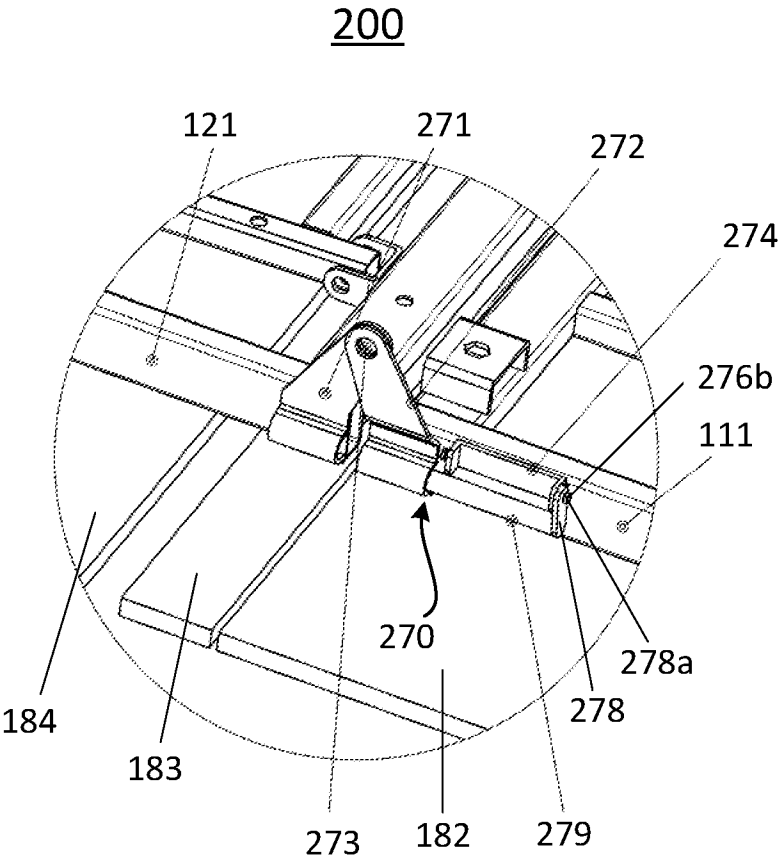
Figure 10:
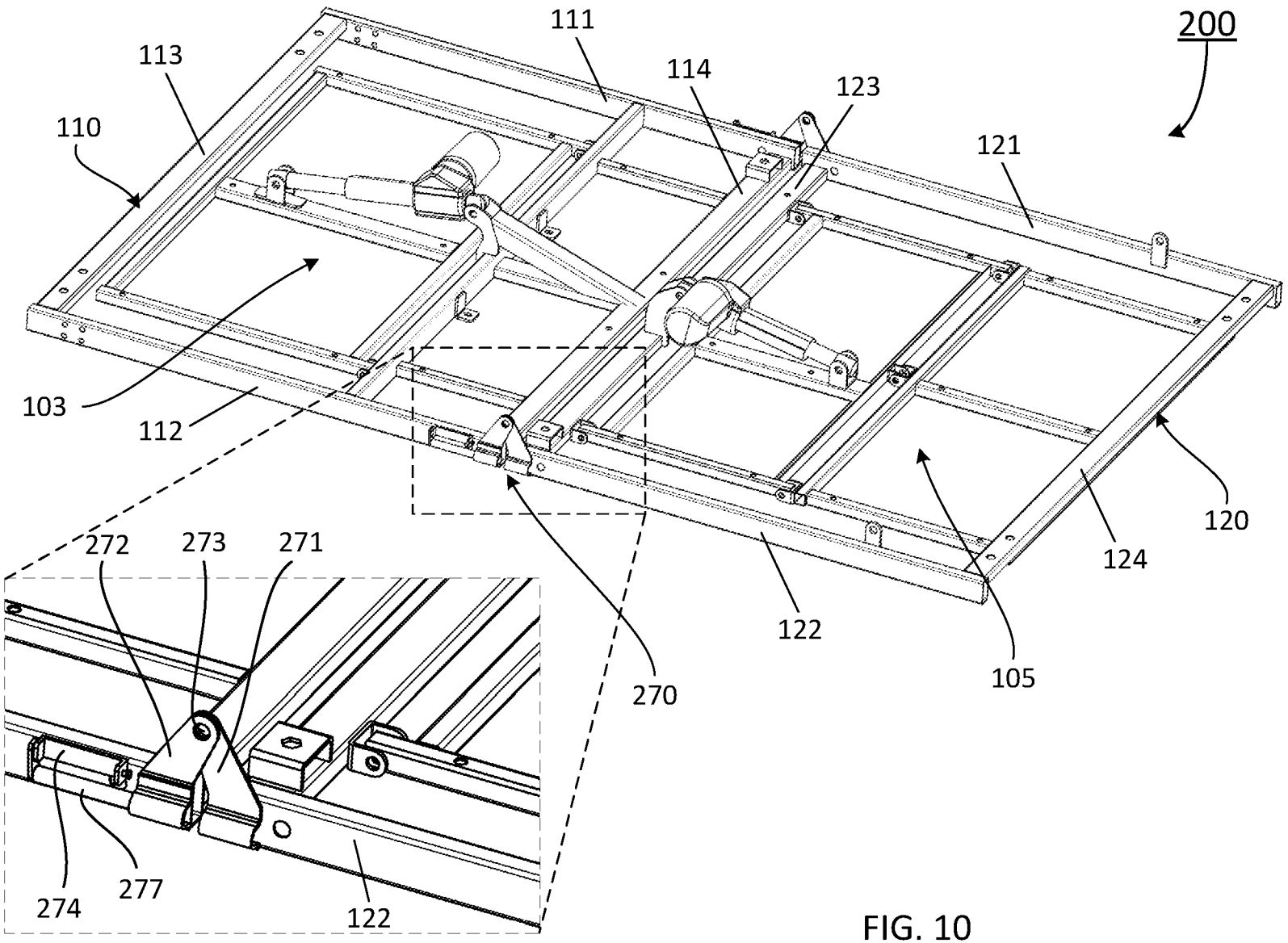
FIG. 10 shows schematically a perspective view of the adjustable bed system shown in FIGS. 9A-9D in the plane state (the bed platforms/boards are not shown).
Figure 11:
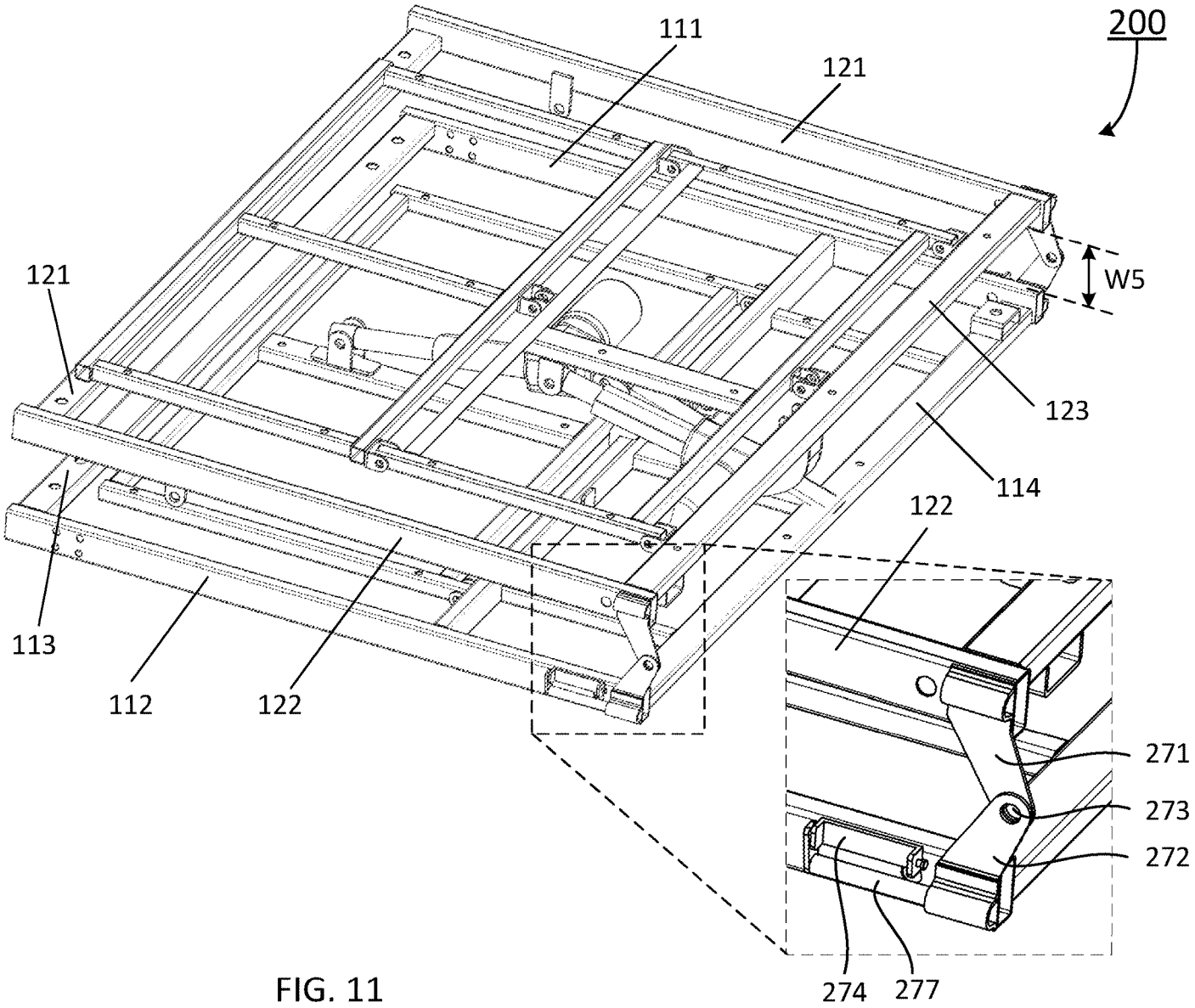
FIG. 11 shows schematically a perspective view of the adjustable bed system shown in FIG. 10 in the folded state.

When the pin 279 is off the groove 271*c* of the first hinge bracket 271, the tab 278 is adjusted and positioned so that the distal protrusion 276*b* of the frame mounting bracket 274 is received in the notch 278*a*, the side rail 111 of the first frame 120 and the side rail 121 of the second frame 120 are unlocked, as shown in FIGS. 9C and 10. In this case, the first frame 110 and the second frame 120 can be pivotally folded to each other through the pivot 273 in the folded state, as shown in FIGS. 9D and 11. As such, the first frame 110 and the second frame 120 are spatially apart by the width W5, which provides a space for accommodating the back lifting assembly 103 and the leg lifting assembly 105 in the folded state, as shown in FIG. 11.

In sum, the invention provides a bed system that is capable of adjusting body positions based on user's sleep preference so that the user achieves maximum comfort during sleep, and also is foldable so as to reduce the space for storage and transportation.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A foldable connection mechanism used in an adjustable bed system having a first frame and a second frame, comprising:

at least one connecting bracket, each connecting bracket comprising a top portion, and a first side portion and a second side portion vertically extended from two opposite sides of the top portion so as to define a notched receptacle between the top portion, the first side portion and the second side portion, wherein the first side portion has two through holes spatial-apart formed therein, wherein in use, two adjacent end portions of the first frame and the second frame of the adjustable bed system are received in the notched receptacle and pivotally connected to the connecting bracket through the two through holes respectively, wherein each connecting bracket further comprises a tab transversely extended from the second side so that the tab is parallel to the top portion, wherein the tab has a middle portion, a first flange and a second flange extended oppositely from two sides of the middle portion so that the first flange and the second flange are co-planar, and the middle portion is positioned between the first flange and the top portion of the connecting bracket or the second flange and the top portion of the connecting bracket, wherein the middle portion of the tab has a mounting hole defined therein.

2. An adjustable bed system, comprising:

a base frame structure having a first frame and a second frame; and the foldable connection mechanism of claim 1, for connecting the first frame and the second frame such that the first frame and the second frame are pivotally foldable relative to one another at the foldable connection mechanism.

3. The adjustable bed system of claim 2, further comprising at least one of a back lifting assembly and a leg lifting assembly, wherein the back lifting assembly comprises a back lifting bracket pivotally connected to the first frame, and at least one back lifting actuator pivotally connected between the back lifting bracket and the first frame for operably driving the back lifting bracket to pivotally move in an upward rotating direction or a downward rotating direction relative to the first frame; and wherein the leg lifting assembly comprises a leg lifting bracket pivotally connected to the second frame structure, and at least one leg lifting actuator pivotally connected between the leg lifting bracket and the second frame for operably driving the leg lifting bracket to pivotally move in an upward rotating direction or a downward rotating direction relative to the second frame.

4. The adjustable bed system of claim 3, wherein the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the first frame and the second end portion of the activation rod pivotally connected to the back lifting bracket, or wherein the motor member is pivotally connected to the back lifting bracket and the second end portion of the activation rod pivotally connected to the first frame.

5. The adjustable bed system of claim 3, wherein the at least one leg lifting actuator comprises the at least one back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the second frame and the second end portion of the activation rod pivotally connected to the leg lifting bracket, or wherein the motor member is pivotally connected to the leg lifting bracket and the second end portion of the activation rod pivotally connected to the second frame.

6. The adjustable bed system of claim 3, further comprising a plurality of platforms disposed on the base frame structure and coupled with the back lifting assembly and the leg lifting assembly such that positions of at least one or more of the plurality of platforms are adjustable in accordance with operations of the back lifting assembly and the leg lifting assembly.

* * * * *